US006491112B1

(12) United States Patent
Shin

(10) Patent No.: US 6,491,112 B1
(45) Date of Patent: Dec. 10, 2002

(54) DRIVING TOOL FOR FASTENING FASTENERS

(75) Inventor: Tae-Hong Shin, Kyonggi-Do (KR)

(73) Assignee: Donguen Electronics Co., Ltd., Seoul (KR)

( * ) Notice: Subject to any disclaimer, the term of this patent is extended or adjusted under 35 U.S.C. 154(b) by 97 days.

(21) Appl. No.: 09/631,218

(22) Filed: Aug. 3, 2000

(30) Foreign Application Priority Data

Nov. 19, 1999 (KR) ..... 99-25552
Mar. 11, 2000 (KR) ..... 00-12246

(51) Int. Cl.[7] ..... B25D 15/00
(52) U.S. Cl. ..... 173/93.5; 173/93; 173/93.6; 173/176; 173/171
(58) Field of Search ..... 173/93, 93.5, 93.6, 173/171, 176

(56) References Cited

U.S. PATENT DOCUMENTS 4,157,120 A * 6/1979 Anderson ..... 173/93
4,458,565 A * 7/1984 Zilly et al. ..... 173/178
4,625,903 A * 12/1986 Becht ..... 173/13
4,687,126 A * 8/1987 Brosius et al. ..... 173/206
4,817,736 A * 4/1989 Ono ..... 173/93
5,158,354 A * 10/1992 Simonin ..... 173/164
5,379,851 A * 1/1995 Huang ..... 173/179
5,412,546 A * 5/1995 Huang ..... 173/176
5,435,398 A * 7/1995 Juan ..... 173/176
5,511,715 A * 4/1996 Crutcher et al. ..... 227/131
5,740,892 A * 4/1998 Huang ..... 173/179
5,887,666 A * 3/1999 Chen et al. ..... 173/93
5,954,141 A * 9/1999 Li et al. ..... 173/109
5,992,538 A * 11/1999 Marcengill et al. ..... 173/171
6,059,049 A * 5/2000 Lin ..... 173/218
6,186,247 B1 * 2/2001 Wang ..... 173/176
6,209,658 B1 * 4/2001 Yoon ..... 173/176
6,223,834 B1 * 5/2001 Takamura et al. ..... 173/211

* cited by examiner

*Primary Examiner*—Rinaldi I. Rada
*Assistant Examiner*—Louis Tran
(74) *Attorney, Agent, or Firm*—Howard & Howard

(57) ABSTRACT

A driving tool includes a hammer which hits instantaneously a connecting member for connecting the hammer with a spindle provided with a wrench at an end thereof. A housing has an on-off switch provided at a grip thereof and is divided into a part chamber in which parts are disposed and a motor chamber in which a motor is disposed. An inertial wheel is installed rotatably in the part chamber and engaged with a shaft of the motor, and a spindle is installed rotatably between the part chamber and the inertial wheel and provided with a connecting member on an outer circumference thereof and a wrench on one end thereof. The hammer is pivotally installed at the inertial wheel to hit the connecting member by centrifugal force according to the rotation of the inertial wheel and returned an initial position by a return spring positioned between the inertial wheel and the hammer. A pair of balls contained in holes are formed at both sides of the inertial wheel and arc shaped grooves formed at the hammer, respectively. Each of springs presses the balls into the holes inwardly, and screws are threaded to the holes for adjusting the pressing force of the balls by the springs, respectively.

9 Claims, 9 Drawing Sheets

DRIVING TOOL FOR FASTENING FASTENERS

BACKGROUND OF THE INVENTION

The present invention relates to a driving tool for fastening fasteners, more particularly to a tool for electrically fastening or unfastening fasteners, such as the bolts used for mounting tires on an automobile.

DESCRIPTION OF THE PRIOR ART

Generally, fasteners, such as bolts, used for mounting tires on an automobile frequently become frozen in place, e.g., by rust, so that they are difficult to remove by conventional wrenches. This problem is particularly present when changing a vehicle tire if the tire bolts have not been removed for a long period of time. When this occurs, women or older and weaker persons are not able to unfasten the tire bolts because it is necessary to apply an extremely large force to the tire bolts in order to unfasten them. Various driving tools have been designed in order to resolve this problem, these driving tools are all driven by a power of motor.

In operation of these conventional driving tools, however, chattering occur with irregular and inaccurate hitting of a hammer since the engaging speed of the hammer and a connecting member is slow, the connecting member is for connecting the hammer to a spindle of which one end is provided with a wrench. Also, the chattering cause wear of parts in those driving tools and shortens their lifetime thereof.

SUMMARY OF THE INVENTION

An object of the present invention is to provide a driving tool for fastening fasteners of which a lifetime can be increased by regularly and accurately hitting a connecting member for connecting the hammer to a spindle and preventing chattering from generating therein.

Another object of the present invention is to provide a driving tool for fastening fasteners which can easily be used by women or older and weaker persons for mounting tires on an automobile.

These and other objects can be accomplished a driving tool for fastening fasteners according to one embodiment of the present invention which comprises a housing having a switch provided at a grip thereof and being divided into a part chamber in which parts are disposed and a motor chamber in which a motor is disposed; an inertial wheel being installed rotatably in the part chamber and engaged with a shaft of the motor; a spindle being installed rotatably between the part chamber and the inertial wheel and provided with a connecting member on an outer circumference thereof and a wrench on an end thereof; a hammer being pivotally installed at the inertial wheel to hit the connecting member by centrifugal force according to the rotation of the inertial wheel and returned to the initial position by a return spring positioned between the inertial wheel and the hammer; and means for accelerating instantaneously the pivoting motion of the hammer when the hammer is pivoted outwardly.

The hammer is preferably provided with a weighting member positioned at the rear portion thereof.

The weighting member has a weight against a spring force of the return spring such that the rear portion of the hammer can be pivoted outwardly when the inertial wheel is rotated.

The return spring has a loop shape to contain the rear portion of the inertial wheel.

The accelerating means includes a pair of balls contained in holes formed at both sides of the inertial wheel and arc shaped grooves formed at the hammer, respectively, springs for pressing the balls into the holes inwardly, respectively, and screws threaded to the holes for adjusting the pressing force of the balls by the springs, respectively.

The accelerating means may also includes an acceleration plate moving in the same direction as that of the hammer and having a recess for containing and supporting the rear portion of the hammer and an opening for containing the rear shaft of the inertia wheel, a cylindrical body engaged with the rear portion of the hammer and supporting the return spring, and a spring and a ball for accurately positioning the accelerating plate.

The spindle has a key groove at the outer side thereof, the connecting member has a hollow portion in the center thereof, the hollow portion has jaws formed at the inner surface thereof in a certain angle, a pair of springs are provided oppositely between the hollow portion and the spindle to absorb shock generated when the key engaged in the key groove is caught on one of jaws in both directions.

Alternatively, these and other objects can be accomplished a driving tool for fastening fasteners according to another embodiment of the present invention which comprise a housing having on-off switch provided at a grip thereof and being divided into a part chamber in which parts are disposed and a motor chamber in which a motor is disposed; an inertial wheel being installed rotatably in the part chamber and engaged with a shaft of the motor; a spindle being installed rotatably between the part chamber and the inertial wheel and provided with a connecting member on an outer circumference thereof and a wrench on an end thereof; a hammer being pivotally installed at the inertial wheel to hit the connecting member by centrifugal force according to the rotation of the inertial wheel and returned an initial position by a return spring positioned between the inertial wheel and the hammer; a hitting adjusting plate for gripping an upper portion of the hammer to accelerate instantaneously the pivoting motion of the hammer when the hammer is pivoted outwardly; and means for absorbing shock generated when the hammer hits the connecting member and provided between the spindle and the connecting member.

The hammering adjusting plate is directly connected with the hammer.

The means for absorbing shock is a pair of springs which are disposed oppositely between the spindle and the connecting member when the spindle is coupled with the connecting member.

BRIEF DESCRIPTION OF THE DRAWINGS

The invention will be better understand and objects other than those set forth above will become apparent when consideration is given the following detailed description thereof. Such description makes reference to the appended drawings wherein.

DESCRIPTION OF THE PREFERRED EMBODIMENTS

Figure 1:
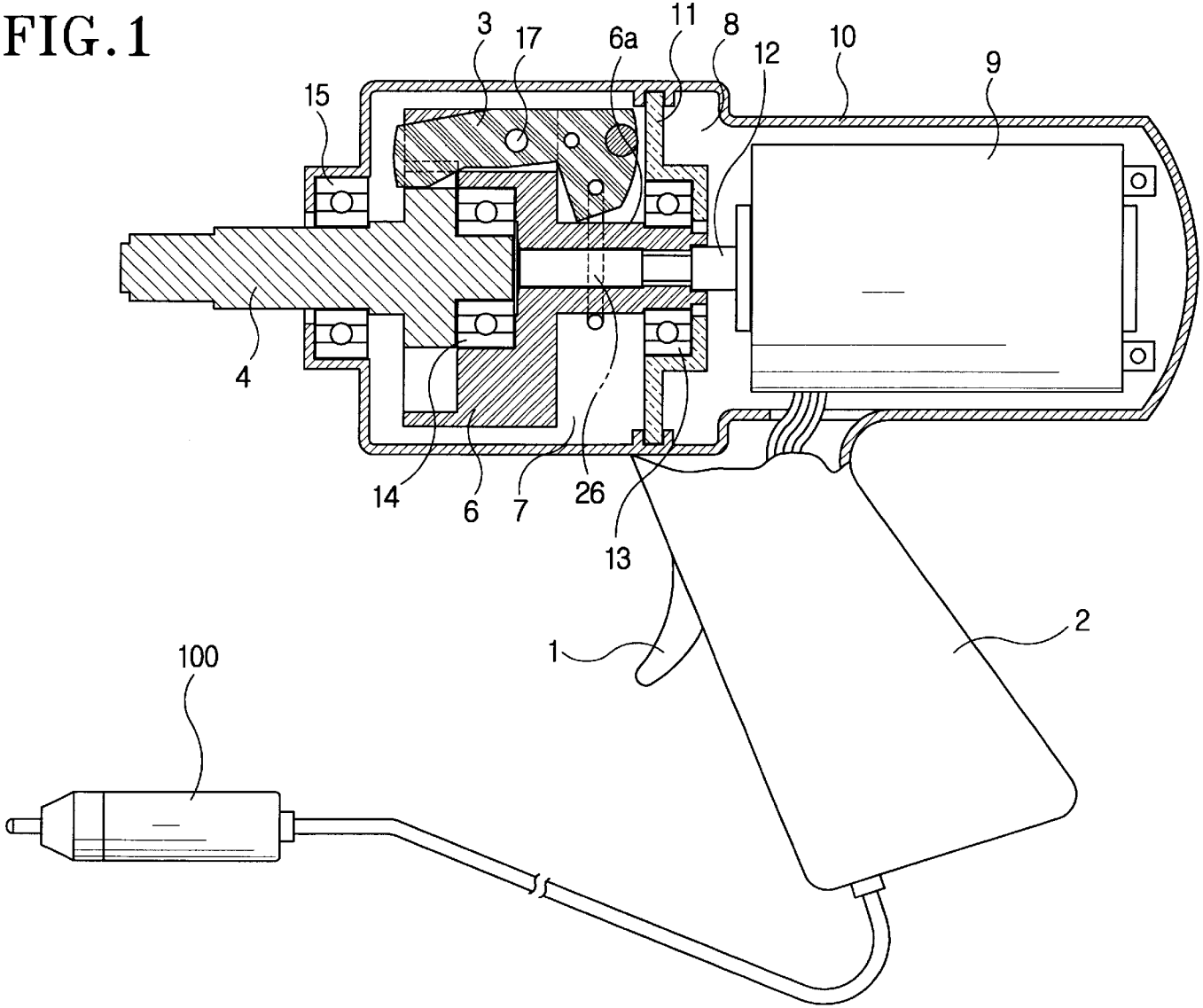
FIG. 1 is a sectional view of a driving tool according to a first embodiment of the present invention.

With reference now to the drawings, and in particular to FIGS. 1 to 4, a driving tool according to a first embodiment of the present invention will be described. As shown in FIG. 1, the driving tool has a handgun shaped housing 10, the housing 10 is divided into divided into a part chamber 7 in which various parts are disposed and a motor chamber 8 in which a motor 9 is disposed, by a partition 11. The motor 9 is driven by operation of an on-off switch 1 provided at a grip of the handgun. An electric current is supplied to the motor 9 through a connector 100 from an external electric source when the switch 1 is ON.

A shaft 12 of the motor 9 is engaged with one end of a shaft 6*a* of an inertia wheel 6 passing through the partition 11, the shaft 6*a* of an inertia wheel 6 is rotatably supported by a bearing 13 provided at the partition 11. The other end of the inertia wheel 6 is formed with a circular bearing seat, a bearing 14 for rotatably supporting one end of a spindle 4 is seated in the circular bearing seat. The spindle 4 is provided with a wrench (not shown) for fastening or unfastening bolts on one end thereof. A middle portion of the spindle 4 is rotatably supported by a bearing 15 provided at the front portion of the housing 10. Therefore, an assembly of the spindle 4 and the inertia wheel 6 is supported by the bearings 13 and 15 at both ends thereof.

Figure 2:
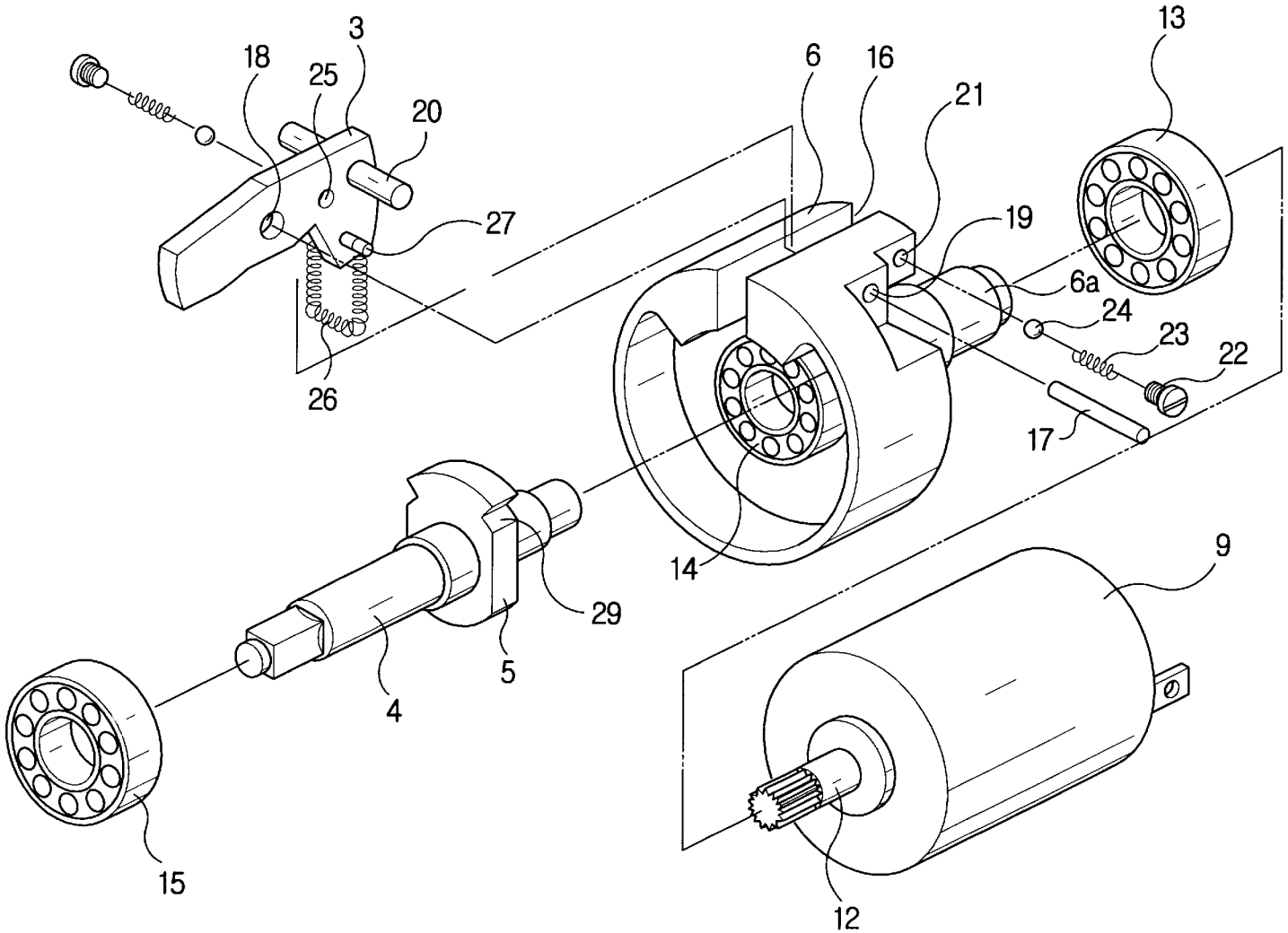
FIG. 2 is an exploded perspective view of the driving tool shown in FIG. 1.

The inertia wheel 6, as shown in FIG. 2, has a cut opening 16 formed in the longitudinal direction at an upper portion thereof. A hammer 3 having a plate shape is pivotally installed in the cut opening 16. The hammer 3 can be inwardly and outwardly pivoted in the cut opening 16 about a pin 17 as the pin 17 is inserted into a thru hole 18 formed at the hammer 3 and thru holes 19 formed at the inertia wheel 6 in the state that the thru hole 18 corresponds to the thru holes 19 when the hammer 3 is contained in the cut opening 16. Therefore, a rear portion of the hammer 3 is pivoted outwardly about the pin 17 by centrifugal force generated when the inertia wheel 6 is rotated at high speed by the driving force of the motor 9.

In order to assure this pivoting motion of the hammer 3, weighting members 20 are preferably disposed at the rear portion of the hammer 3. The weighting members 20 may be shafts extending laterally from both sides of the hammer 3. Also, the size of these weighting members 20 can be properly varied according to the centrifugal force acting on the rear portion of the hammer 3.

Figure 4A:
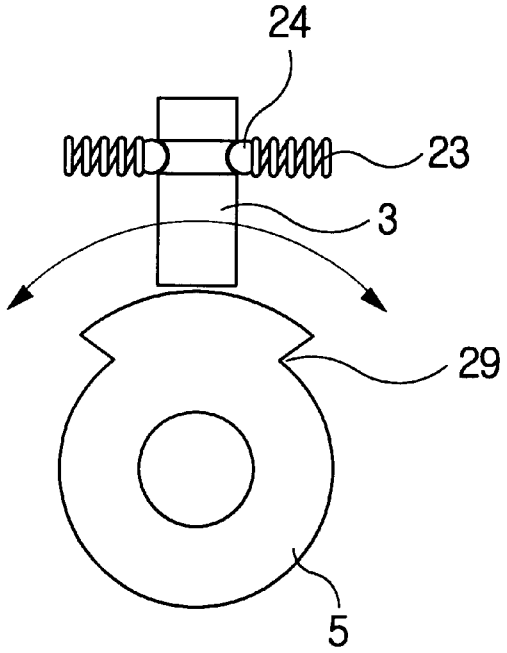
FIGS. 4*a* and 4*b* are views showing the hitting relationship of the hammer to the connecting member.

A pair of ball inserting holes 21 are formed behind the holes 19 in the inertia wheel 6, the holes 21 extend from one side of the rear portion of the inertia wheel 6 through the cut opening 16 to the other side thereof. The holes 21 are aligned with recesses 25, which are formed at both sides of the rear portion of the hammer 3, respectively and have a semi-sphere shape, when the hammer 3 is positioned in the cut opening 16 of the inertia wheel 6. As shown in FIGS. 2 and 4*a*, if the hammer 3 is positioned in the cut opening 16 of the inertia wheel 6, a pair of balls 24 are inserted into the holes 21 from the outside. A pair of springs 23 are then in inserted the holes 21 from outside. When the springs 23 are then in inserted the holes 21, screws 22 are engaged with threaded portions formed at entries of the holes 21, respectively. When screws 22 are engaged with the holes 21, respectively, the balls 24 are pressed toward and seated in the recesses 25 formed at the hammer 3 by the springs 23. Therefore, the pressing force to the recesses 25 by the springs 23 can be adjusted by varying the engaging length of the screws 22.

Figure 4B:
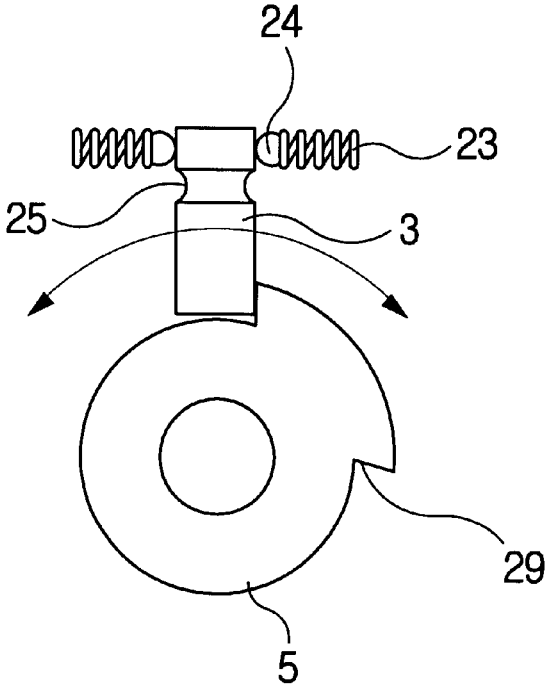

Accordingly, it is appreciated that the pivoting motion of the hammer 3 is prevented if the centrifugal force acting on the rear portion of the hammer 3 by the rotation of the inertia wheel 6 is smaller than the resultant force of the springs 23 and a spring 26 for returning the hammer 3 to its initial position. If the centrifugal force is, however, smaller than the resultant force of the springs 23 and 26, the rear portion of the hammer 3 is pivoted outwardly by the centrifugal force, the balls 24 are separated from the recesses 25 with the pivoting motion of the hammer 3, respectively, as shown in FIG. 4*b* (actually, the recesses 25 should be positioned above the springs 23, but the recesses 25 are shown to be positioned below the springs 23 in FIG. 4*b*). The rear portion of the hammer 3 is instantaneously and rapidly pivoted outwardly about the pin 17 when the balls 24 are separated from the recesses 25.

Figure 3:
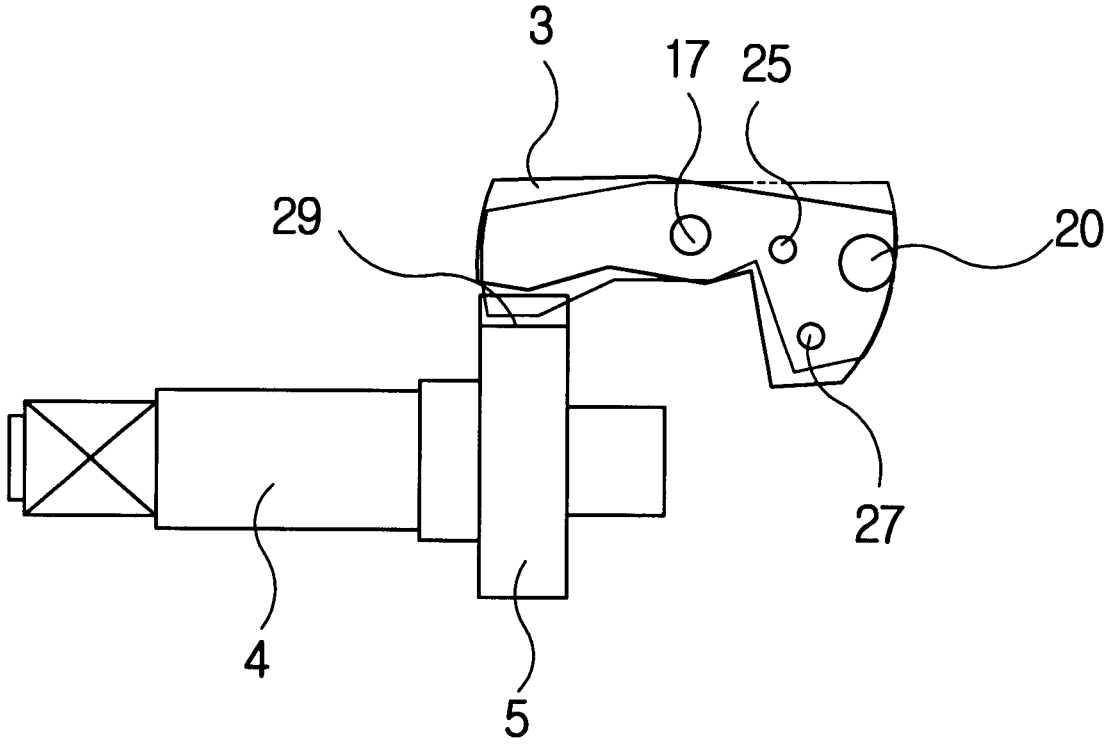
FIG. 3 is a view schematically showing the relationship of a connecting member and a hammer in the driving tool shown in FIGS. 1 and 2.

As above described, when the rear portion of the hammer 3 is pivoted outwardly about the pin 17 by centrifugal force, a front portion of the hammer 3, as shown by a two-doted chain line in FIG. 3, instantaneously hits any one of a pair of jaws 29 formed on an upper portion of a connecting member 5, which is provided on the outside of the spindle 4. The spindle 4 is rotated in the rotational direction of the inertia wheel 6, as the hammer 3 rotating together with the inertia wheel 6 hits on and engages with any one of the pair of jaws 29.

Accordingly, the hammer 3 hits instantaneously the connecting member 5, whereby an engagement of two members 3 and 5 becomes instantaneously and rapidly so that the chattering by irregular and inaccurate hitting is prevented from generating in the driving tool.

Therefore, the balls 24, the springs 23 and the screws 22, as above described, constitute means for instantaneously accelerating the hitting speed of the hammer 3.

In the driving tool according to the present invention, the centrifugal force acting on the rear portion of the hammer 3 by the rotation of the inertia wheel 6 is larger than the pressing force of the springs 23 acting on the recesses 25 through the balls 24 and the force of the spring 26 for returning the hammer 3 to its initial position, when the RPM of the inertia wheel 6 is more than about 4,000. As above described, the RPM of the inertia wheel 6 for generating the centrifugal force on the rear portion of the hammer 3 can be adjusted by varying the engaging length of the screws 22 with the holes 21.

Also, as the spindle 4 is rotated with instantaneous engagement of the hammer 3 with the connecting member 5, the bolts for mounting a tire are fastened or unfastened by the wrench provided at one end of the spindle 4. When the bolts, however, become frozen with the force greater than the rotary power of the spindle 4, and the spindle 4 is stopped. While the spindle 4 is stopped, the motor 9 of which the power is transferred to the spindle 4 through the hammer 3 and the inertia wheel 6 becomes overloaded.

In order to prevent the overload of the motor 9 from generating therein, the spring 26 for returning the hammer 3 to its initial position, i.e. a position before the centrifugal force acts on the rear portion of the hammer 3, is provided at the rear portion of the hammer 3. The spring 26 has a loop shape as both ends thereof are connected to protrusions 27 formed on both sides of the hammer 3. As shown in FIG. 1, the shaft 6*a* of the inertia wheel 6 is passed through the loop shape of spring 26.

As the spindle 4 is stopped, the centrifugal force acting on the rear portion of the hammer 3 is removed from the hammer 3. When the centrifugal force acting on the hammer 3 is smaller than the force of the spring 26, the hammer 3 is returned to the initial position by the force of the spring 26. The hammer 3 is disengaged with the connecting member 5 while the hammer 3 is returned to the initial position. Therefore, the power of the motor 9 is transferred to the hammer 3, and then the overload of the motor 9 is released.

When the rotational speed of the inertia wheel 6 is about 4,000 RPM, the rear portion of the hammer 3 is pivoted outwardly about the pin 17 by the centrifugal force acting thereon so that the front portion of the hammer 3 hits the connecting member 5 to rotate the spindle 4. This action is repeated until the bolts are completely fastened or unfastened.

Figure 5:
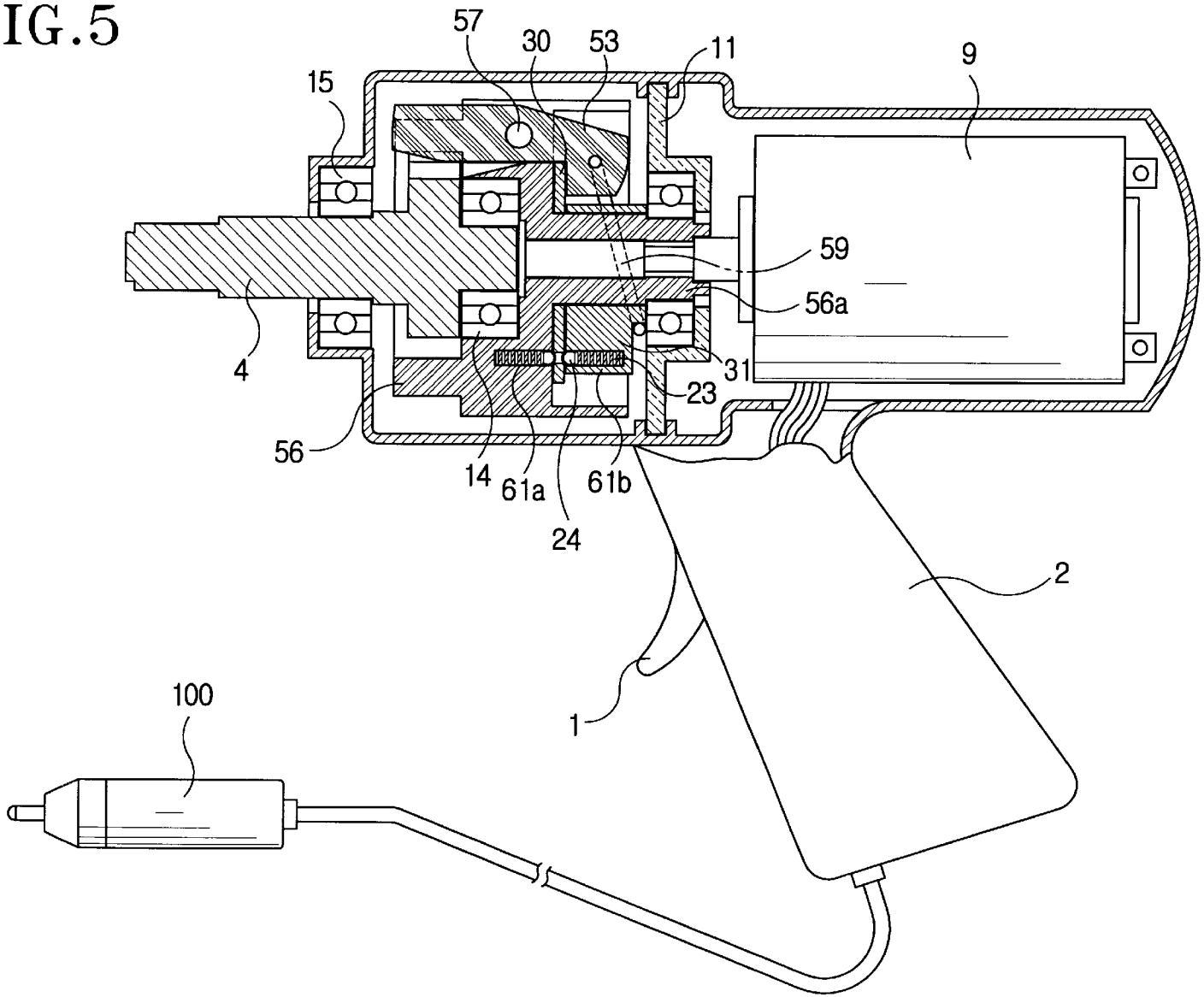
FIG. 5 is a sectional view of a driving tool according to a second embodiment of the present invention.

FIG. 5 is a sectional view of a driving tool according to a second embodiment of the present invention. On the other hand, a hammer 53 used in this embodiment is similar to the hammer 3 of the first embodiment, but means for instantaneously accelerating the pivoting motion of the hammer 53 is different from that of the first embodiment. Therefore, detailed description of parts similar to the first embodiment is omitted.

In a driving tool shown in FIG. 5, when the hammer 53 is contained in the cut opening 16 of the inertia wheel 56, a hole 58 formed at the hammer 53 is aligned with holes 51 formed at both sides of the cut opening 16, a pin 57 is inserted into the holes 51 and 58 aligned with each other. Therefore, the hammer 53 can be pivoted about the pin 57 outwardly when the centrifugal force acts on a rear portion of the hammer 53. As shown in FIG. 5, a rear shaft 56*a* of the inertia wheel 56 is coupled with an acceleration plate 30 and a cylindrical body 31. The acceleration plate 30 has an opening 32 for containing the rear shaft 56*a* of the inertia wheel 56 at the central part thereof and a recess 35 for containing and supporting the rear portion of the hammer 53 at an upper portion thereof. As knows from FIG. 6, it is preferable that the upper part of the acceleration plate 30 has a weight heavier than a lower part thereof.

Figure 6:
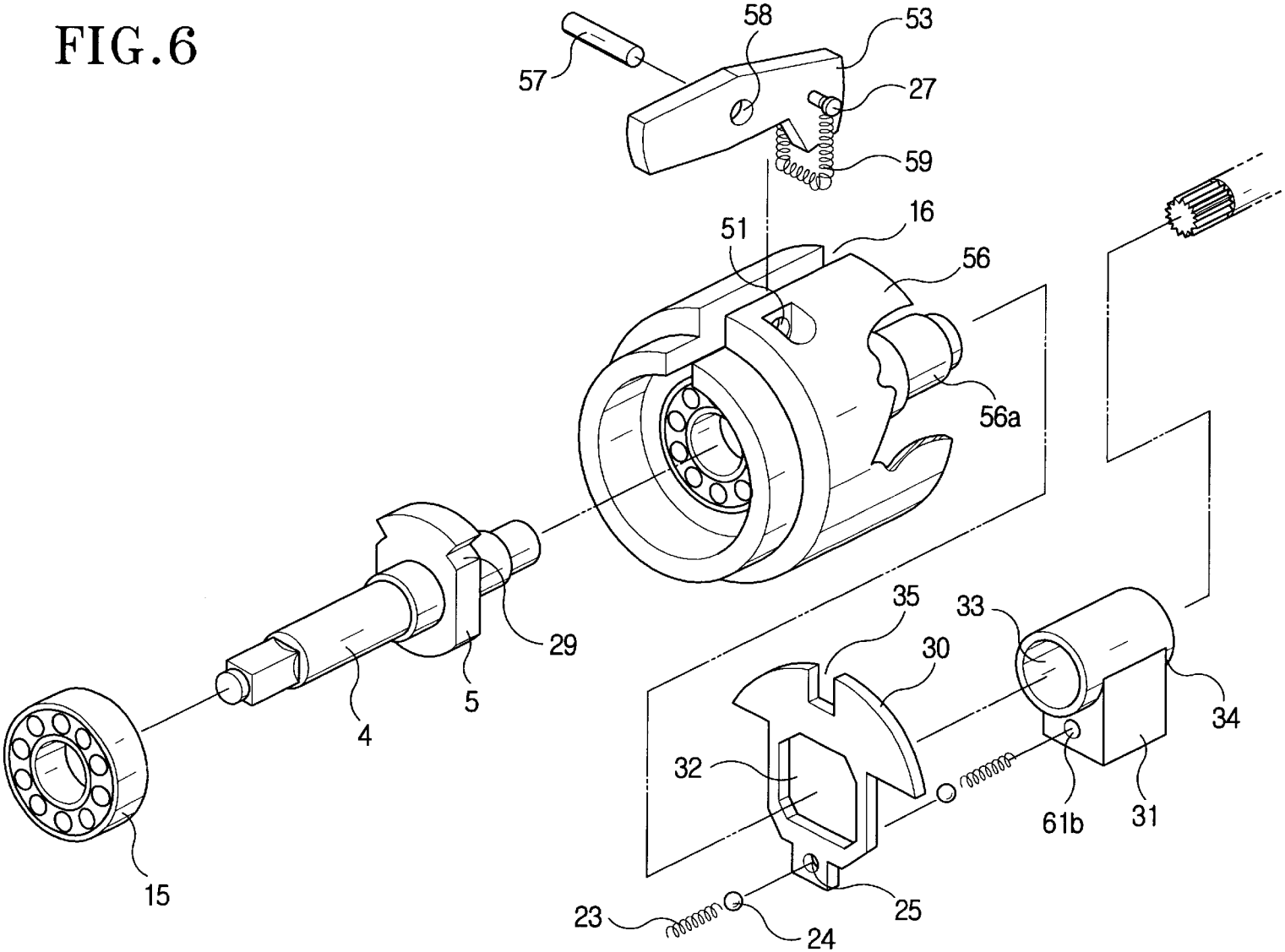
FIG. 6 is an exploded perspective view of the driving tool shown in FIG. 5.

The rear shaft 56*a* of the inertia wheel 56 passes through the opening 32 of the acceleration plate 30 and then is coupled with the cylindrical body 31. The hammer 53 is returned by a spring 59 for returning the hammer 53 to its initial position, when the rear portion thereof is pivoted outwardly and then the inertia wheel 56 is stopped. The spring 59 has same configuration as that of the first embodiment, as shown in FIG. 6. That is, the spring 59 has a loop shape as both ends thereof are connected to protrusions 27 formed on both sides of the hammer 53, and the end portion 34 of the cylindrical body 31 is coupled to the rear shaft 56*a* of the inertia wheel 56 which is contained in the loop shape of spring 59.

In this embodiment, the acceleration plate 30, the springs 23 and the balls 24 constitute means for instantaneously accelerating the hitting speed of the hammer 53. That is, the acceleration plate 30, as knows from FIGS. 5 and 6, has semi-sphere shaped recesses 25 formed at both sides of the lower portion thereof, and a pair of balls 24 are pressed toward and contained in the recesses 25 by forces of a pair of springs 23. The springs 23 are positioned in holes 61*a* and 61*b* which are formed at the inertia wheel 56 and the cylindrical body 31 opposite each other in the longitudinal direction.

When the inertia wheel 56 is rotated at a speed of about 4,000 RPM by the driving of the motor 9, the rear portion of the hammer 53 is pivoted outwardly about the pin 57 since the centrifugal force acts on the rear portion of the hammer 53. When the centrifugal force acts on the rear portion of the hammer 53, centrifugal force also acts on an upper portion of the acceleration plate 30. The acceleration plate 30 moves instantaneously and upwardly when the centrifugal force acting on an upper portion of the acceleration plate 30 is larger than the resultant force of the springs 23 and 59. By the instantaneous moving of the acceleration plate 30, the rear portion of the hammer 53 supported by the recess 35 formed at the upper portion of the acceleration plate 30 is also pushed upwardly. That is, the rear portion of the hammer 53 is pivoted outwardly about the pin 57. Therefore, the upper portion of the acceleration plate 30 functions as the weighting members 20 of the former embodiment.

As above described, the front portion of the hammer 53 hits one of two jaws 29 of the connecting member 5 like in the former embodiment, since the rear portion of the hammer 53 is pivoted outwardly about the pin 57. Therefore, the spindle 4 is rotated in the rotational direction of the inertia wheel 56, as the hammer 53 rotating together with the inertia wheel 56 hits and engages any one of the pair of jaws 29.

Accordingly, the hammer 53 instantaneously hits the connecting member 5, whereby an engagement of two members 53 and 5 becomes instantaneous and rapid so that the chattering by irregular and inaccurate hitting of the hammer 53 is prevented from generating in the driving tool.

The centrifugal force acting on the rear portion of the hammer 53 by the rotation of the inertia wheel 56 is larger than the resultant force of the springs 23 and the spring 59, when the RPM of the inertia wheel 56 is greater than about 4,000.

Also, like in the former embodiment, the bolts for mounting a tire in a vehicle are fastened or unfastened by the wrench provided at one end of the spindle 4, as the spindle 4 is rotated with instantaneous hitting of the hammer 53 on the connecting member 5. When the bolts, however, become frozen with the force larger than the rotary power of the spindle 4, the rotation of the spindle 4 stops. While the spindle 4 is stopped, the motor 9 of which power is transferred to the spindle 4 through the hammer 53 and the inertia wheel 56 is overloaded. This overload of the motor 9 is released, as the hammer 53 is disengaged with the connecting member 5 while the hammer 53 is returned to its initial position, and then the power of the motor 9 is again transferred to the hammer 53. This action is repeated until the bolts are completely fastened or unfastened.

Figure 7:
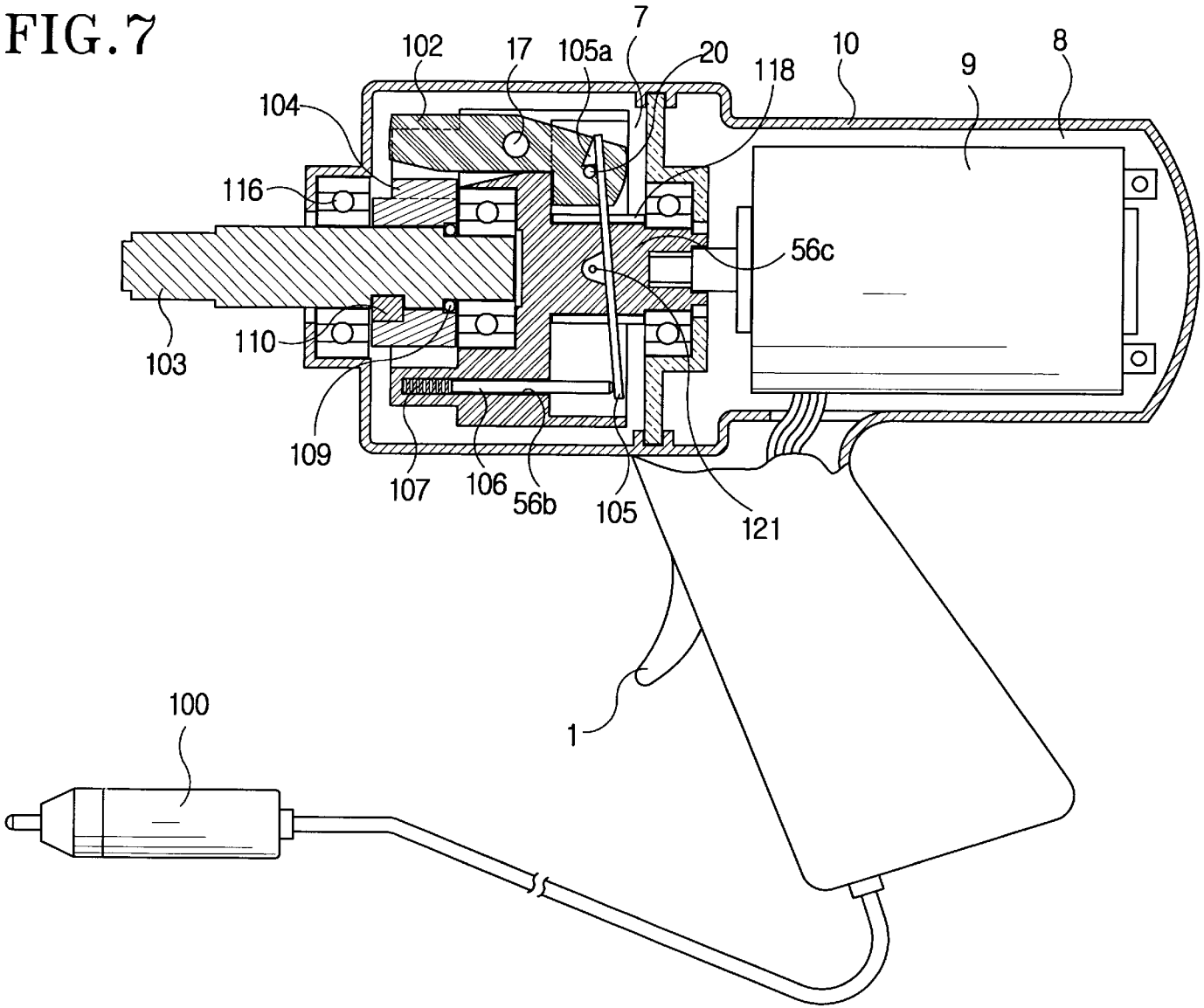
FIG. 7 is a sectional view of a driving tool according to a third embodiment of the present invention.
Figure 8:
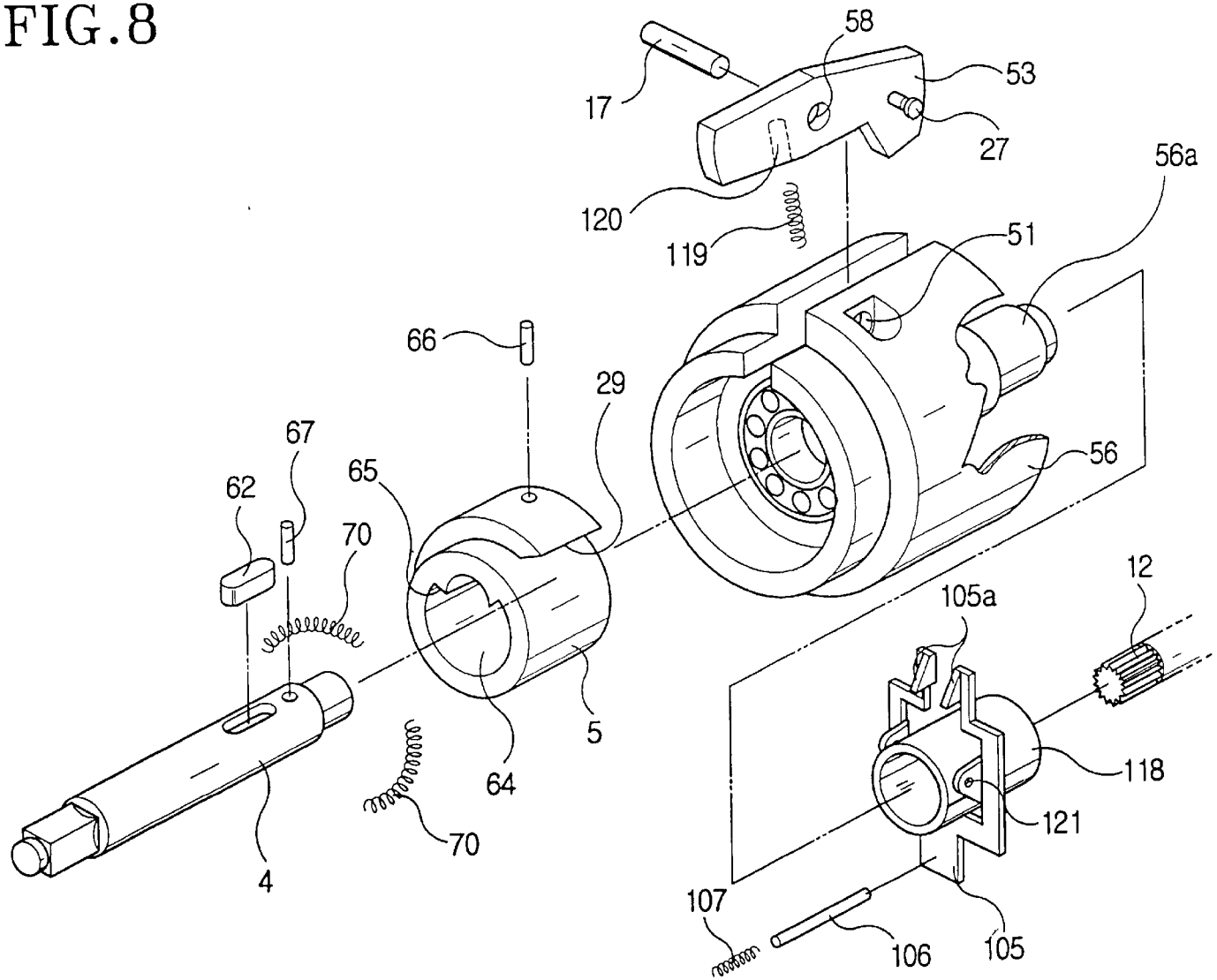
FIG. 8 is an exploded perspective view of the driving tool shown in FIG. 7.

FIG. 7 is a sectional view of a driving tool according to a third embodiment of the present invention. As shown in FIGS. 7 and 8, the hammer 53 is also installed to the inertia wheel 56 to be outwardly pivoted about the pin 17 by the centrifugal force generated when the inertia wheel 56 rotates. In the front of the pin 17, there is provided a spring 119 contained in a hole 120 formed at a lower surface of the hammer 53 for pressing outwardly a front portion of the hammer 53 so that a rear portion of the hammer 53 is pivoted about the pin 17 by the force of the spring 119.

The hammer 53 has weighting members 20 disposed at the rear portion of the hammer 53. The weighting members 20 may be shafts extending laterally from both sides of the hammer 53. The weighting members 20 are caught on stoppers 105*a* provided at an upper portion of an acceleration plate 105, this acceleration plate 105 is pivotally installed to a cylindrical body 118 by a pin 121, and the cylindrical body 118 is coupled with the shaft 56*a* of the inertia wheel 56. A lower portion of the acceleration plate 105 is pressed rearward by a rod 106 on which a force of a spring 107 is applied, and leaned at a certain angle. The spring 107 and the rod 106 are in turn contained in holes 56*b* formed at a lower portion of the inertia wheel 56, and one end of the spring 107 is elastically supported by a closed end of the holes 56*b*.

As above described, the weighting members 20 disposed at the rear portion of the hammer 53 are caught on the stopper 105*a* of the acceleration plate 105 when the lower portion of the acceleration plate 105 is pressed rearward by the rod 106. Therefore, the hammer 53 is coupled directly to the acceleration plate 105 since the weighting members 20 disposed at the rear portion of the hammer 53 are caught on the stoppers 105*a* of the acceleration plate 105.

Centrifugal force acts on not only the rear portion of the hammer 53 but also on the upper portion of the acceleration plate 105 when the inertia wheel 56 is rotated at a rotational speed, for example more than 4,000 RPM in the state that the weighting member 20 are caught on the stopper 105*a* of the acceleration plate 105. By centrifugal force acting on the rear portion of the hammer 53 and the upper portion of the acceleration plate 105, the rear portion of the hammer 53 tends to pivot outwardly against the force of the spring 119 and the acceleration plate 105 is pivoted downwardly and tends to move upright against the force of the spring 107.

If the centrifugal force acting on the upper portion of the acceleration plate 105 is larger than the force of the spring 107, the acceleration plate 105 becomes uprightly, and then the weighting member 20 are released from the stopper 105*a* of the acceleration plate 105. At this time, if the centrifugal force acting on the rear portion of the hammer 53 is larger than the force of the spring 119, the front portion of the hammer 53 is moved down and the front portion of the hammer 53 hits one of the jaws 29 provided at the outer circumference of the connecting member 5, so that the spindle 4 connected with the connecting member 5 is rotated by the rotating inertia wheel 56.

Also, like in the former embodiments, the bolts for mounting a tire in a vehicle are fastened or unfastened by the wrench provided at one end of the spindle 4, as the spindle 4 is rotated with instantaneous hitting of the hammer 53 on the connecting member 5. When the bolts, however, is fastened by force larger than the rotary power of the spindle 4, the spindle 4 is also stopped. While the spindle 4 is stopped, the motor 9 becomes overloaded, of which the power is transferred to the spindle 4 through the hammer 53 and the inertia wheel 56. This overload of the motor 9 is released, as the hammer 53 is disengaged with the connecting member 5 while the hammer 53 is returned to its initial position and then the power of the motor 9 is transferred to the hammer 53. This action is repeated until the bolts are completely fastened or unfastened.

Figure 9:
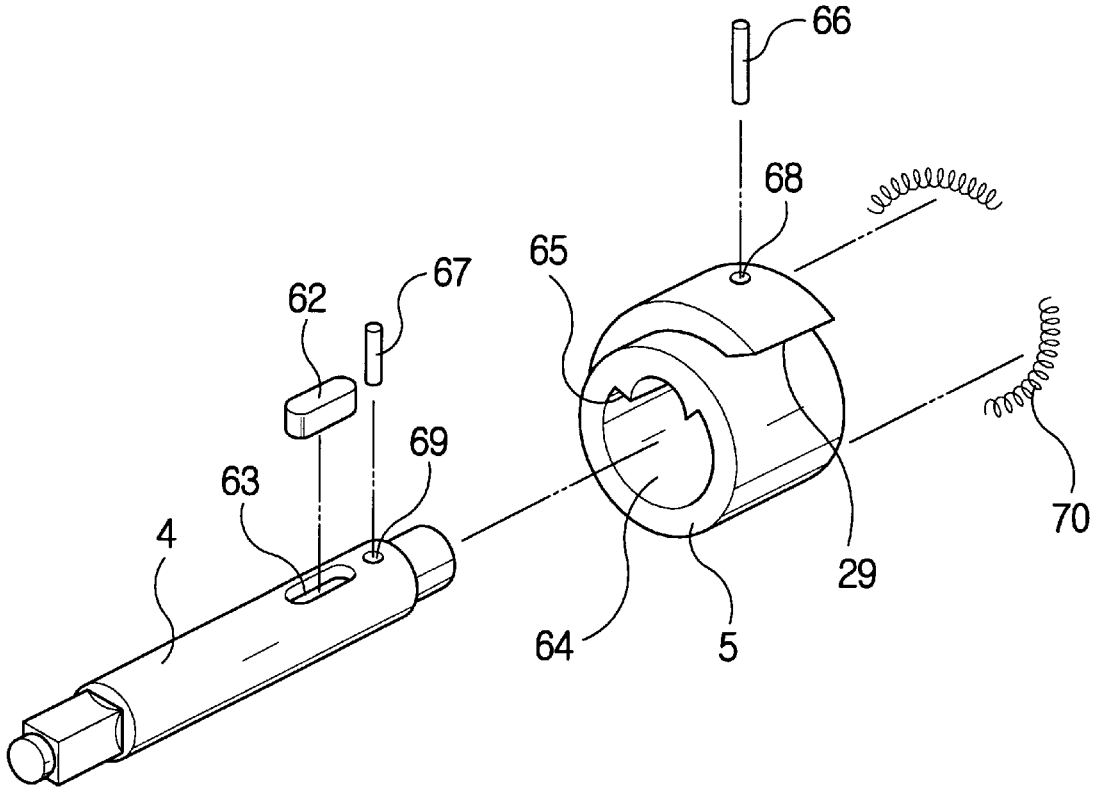
FIG. 9 is an exploded perspective view of a spindle assembly, which can absorb shock generated when the hammer hits the connecting member.

FIG. 9 is an exploded perspective view of a spindle assembly, which can absorb shock generated when the hammer hits the connecting member. As shown in FIG. 9, the spindle 4 can be separated form the connecting member 5. The spindle 4 has a key groove 63, at which a key 62 is seated, formed at an upper side thereof. The key 62 is caught on one of a pair of jaws 65 provided at an inner part 64 of the connecting member 5 when the connecting member 5 is rotated with the hammer 3 or 53 so that the spindle 4 is rotated in the rotational direction of the connecting member 5.

In the spindle 4 and the connecting member 5, pin insert holes 68 and 69 are formed at a predetermined angle, for example 180°, respectively. When the spindle 4 is coupled with the connecting member 5, a pair of springs 70 are provided at arc shaped gaps between the spindle 4 and the connecting member 5. If the springs 70 are provided between the spindle 4 and the connecting member 5, two pins 66 and 67 are inserted into the holes 68 and 69, respectively so that both ends of the springs 70 are secured with the pins 66 and 67. On the other hand, when the spindle 4 is coupled with the connecting member 5, the key 62 is apart from the jaws 65 at a certain distance, as shown in FIG. 10.

Figure 10:
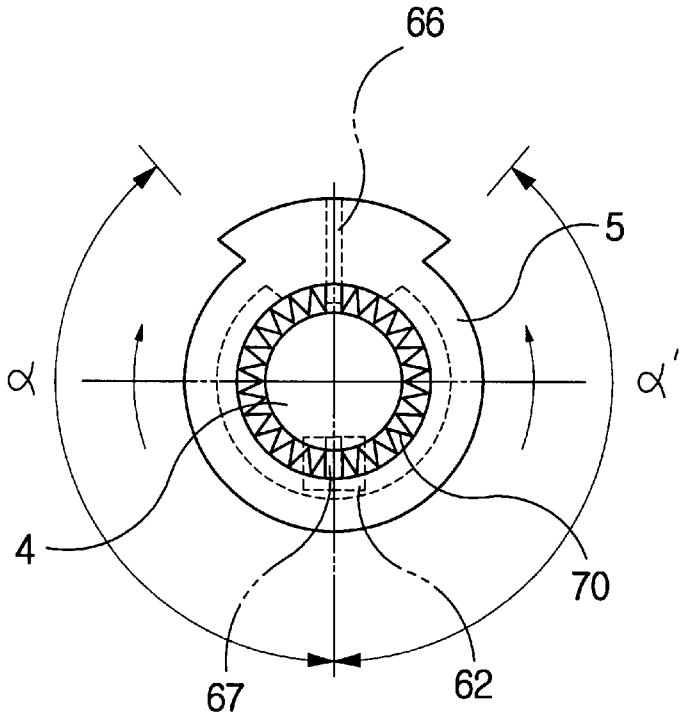
FIG. 10 is a schematic sectional view for illustrating the function for absorbing the shock generating when the hammer hits the connecting member.

As the spindle assembly has a structure as shown in FIGS. 9 and 10, the connecting member 5 is rotated to a position where the key 62 is caught on one of jaws 65, at an angle $\alpha$ or $\alpha'$ of FIG. 10, together with the hammer 3 or 53 when the hammer 3 or 53 hits the connecting member 5. Therefore, the spindle 4 is rotated to fasten or unfasten bolts as the key 62 is caught on one of jaws 65 and is rotated together with one of jaws 65.

When the connecting member 5 is rotated to a position where the key 62 is caught on one of jaws 65, by an angle $\alpha$ or $\alpha'$, one of the springs 70, which is disposed in the rotational direction of jaws 65, is compressed and absorbs the shock energy generated when one of jaws 65 hits the key 62, to thereby prevent creation of the noise due to the shock. At this time, the other of the springs 70 is elongated.

By the driving tool according to the present invention, the lifetime can be increased by regularly and accurately hitting a connecting member for connecting the hammer to a spindle, thus preventing the chattering from generating therein.

Further, the driving tool can easily be used by women or older and weaker persons for mounting a tire on an automobile.

I claim:

1. A driving tool for fastening fasteners, which comprising;

a housing having an switch provided at a grip thereof and being divided into a part chamber in which parts are disposed and a motor chamber in which a motor is disposed;

an inertial wheel being installed rotatably in the part chamber and engaged with a shaft of the motor;

a spindle being installed rotatably between the part chamber and the inertial wheel and provided with a connecting member on an outer circumference thereof and a wrench on an end thereof;

a hammer being pivotally installed at the inertial wheel to hit the connecting member by centrifugal force according to the rotation of the inertial wheel and returned to an initial position by a return spring positioned between the inertial wheel and the hammer; and, means for accelerating instantaneously the pivoting motion of the hammer when the hammer is pivoted outwardly, the accelerating means includes a pair of balls contained in holes formed at both sides of the inertial wheel and arc shaped grooves formed at the hammer, respectively, springs for pressing the balls into the holes inwardly, respectively, and screws threaded to the holes for adjusting pressing force of the balls by the springs, respectively.

2. The driving tool for fastening fasteners as defined in claim 1, the hammer is provided with a weighting member positioned at rear portion thereof.

3. The driving tool for fastening fasteners as defined in claim 2, the weighting member has a weight against a spring force of the return spring such that the rear portion of the hammer can be pivoted outwardly when the inertial wheel is rotated.

4. The driving tool for fastening fasteners as defined in claim 1, the return spring has a loop shape to contain the rear portion of the inertial wheel.

5. The driving tool for fastening fasteners as defined in claim 1, the accelerating means includes a acceleration plate moving in the same direction as that of the hammer and having recess for containing and supporting the rear portion of the hammer and an opening for containing the rear shaft of the inertia wheel, a cylindrical body engaged with the rear portion of the hammer and supporting the return spring, and a spring and a ball for accurately positioning the accelerating plate.

6. A driving tool for fastening fasteners, comprising:

a housing having a switch provided at a grip thereof and being divided into a part chamber in which parts are disposed and a motor chamber in which a motor is disposed;

an inertial wheel being installed rotatably in the part chamber and engaged with a shaft of the motor;

a spindle being installed rotatably between the part chamber and the inertial wheel and provided with a connecting member on an outer circumference thereof and a wrench on an end thereof;

a hammer being pivotally installed at the inertial wheel to hit the connecting member by centrifugal force according to the rotation of the inertial wheel and returned to an initial position by a return spring positioned between the inertial wheel and the hammer; and, means for accelerating instantaneously the pivoting motion of the hammer when the hammer is pivoted outwardly, the spindle has a key groove at outer side thereof, the connecting member has a hollow portion at central thereof, the hollow portion has jaws formed at inner surface thereof at a certain angle, a pair of spring are provided oppositely between the hollow portion and the spindle to absorb shock generated when the key engaged at the key groove is caught on one of jaws in both directions.

7. A driving tool for fastening fasteners, which comprising;

a housing having an on-off switch provided at a grip thereof and being divided into a part chamber in which parts are disposed and a motor chamber in which a motor is disposed;

an inertial wheel being installed rotatably in the part chamber and engaged with a shaft of the motor;

a spindle being installed rotatably between the part chamber and the inertial wheel and provided with a connecting member on an outer circumference thereof and a wrench on an end thereof;

a hammer being pivotally installed at the inertial wheel to hit the connecting member by centrifugal force according to the rotation of the inertial wheel and returned to its initial position by a return spring positioned between the inertial wheel and the hammer;

a hitting adjusting plate for gripping an upper portion of the hammer to accelerate instantaneously the pivoting motion of the hammer when the hammer is pivoted outwardly; and means for absorbing shock generated when the hammer hits the connecting member and provided between the spindle and the connecting member.

8. The driving tool for fastening fasteners as defined in claim 7, the hammering adjusting plate is directly connected with the hammer.

9. The driving tool for fastening fasteners as defined in claim 7, the means for absorbing shock is a pair of springs which are disposed oppositely between the spindle and the connecting member when the spindle is coupled with the connecting member.

* * * * *